United States Patent [19]

Bolin et al.

[11] Patent Number: 5,062,754

[45] Date of Patent: Nov. 5, 1991

[54] BOOKLET, METHOD AND APPARATUS FOR PRODUCING THE SAME

[75] Inventors: Göran Bolin, Täby; Urpo Latvakangas, Saltsjö-Boo; Jan Sabelström, Huddinge, all of Sweden

[73] Assignee: Bindomatic AB, Sweden

[21] Appl. No.: 246,298

[22] PCT Filed: Mar. 13, 1987

[86] PCT No.: PCT/SE87/00130

§ 371 Date: Sep. 8, 1988

§ 102(e) Date: Sep. 8, 1988

[87] PCT Pub. No.: WO87/05565

PCT Pub. Date: Sep. 24, 1987

[30] Foreign Application Priority Data

Mar. 14, 1986 [SE] Sweden ..... 8601216

[51] Int. Cl.[5] ..... B42L 11/00

[52] U.S. Cl. ..... 412/4; 281/21.1; 412/19; 412/29

[58] Field of Search ..... 412/3, 4, 6, 8, 17, 412/900, 1, 9, 22, 29, 19; 281/29, 35, 36, 37, 15 R, 21.1; 156/908

[56] References Cited

U.S. PATENT DOCUMENTS

| | | | |
|---|---|---|---|
| 1,274,154 | 7/1918 | Etheridge | 412/19 |
| 3,030,880 | 4/1962 | Keagle | 412/29 X |
| 3,314,089 | 4/1967 | Margolis et al. | 412/3 |
| 3,466,682 | 9/1969 | French | 412/19 |
| 3,973,787 | 8/1976 | Staats et al. | 281/21.1 |
| 3,992,741 | 11/1976 | Staats | 281/21.1 X |
| 4,009,498 | 3/1977 | Staats et al. | 281/21.1 X |
| 4,129,471 | 12/1978 | Rome | 281/21.1 |
| 4,141,100 | 2/1979 | Domroe et al. | 281/21.1 X |
| 4,204,704 | 5/1980 | Staats | 281/21.1 |
| 4,289,330 | 9/1981 | Wiermanski | 281/21.1 |
| 4,367,061 | 1/1983 | Wilholm | 412/3 |
| 4,606,689 | 8/1986 | Wiholm | 412/3 |

FOREIGN PATENT DOCUMENTS 2072096 9/1981 United Kingdom .

*Primary Examiner*—Paul A. Bell
*Attorney, Agent, or Firm*—Cooper & Dunham

[57] ABSTRACT

The invention disclosed is directed to a method, an apparatus for manufacturing and apparatus for using a booklet, folder or wrapper comprising two substantially parallel covers (1,2) united with a spine (3) at crease lines (5,6). A strip (4) of adhesive binder is attached to the inside of the spine (3) and extends only between the crease lines (5,6). The strip of adhesive (4) is intended to be activated to provide adhesion between itself and one edge of a sheaf of sheets of material which are inserted between the covers (2,3). Two opposing longitudinal side edges of the (**4*a*, 4*b*) of the strip of adhesive (4) are united with the respective covers (1,2) before the sheaf of sheets is inserted between the covers (2,3**).

16 Claims, 4 Drawing Sheets

BOOKLET, METHOD AND APPARATUS FOR PRODUCING THE SAME

TECHNICAL FIELD

The present invention relates to a booklet, a folder, covers or the like and a method and apparatus for their manufacture. More specifically, the invention refers to a folder or the like, comprising two substantially parallel covers, which with the aid of crease lines are connected to a spine on the inside of which and solely between the crease lines there is attached a strip of binding agent, the strip being intended to be activated for providing adhesion between it and one edge of a sheaf of papers inserted between the covers.

BACKGROUND ART

Booklets, etc. of the kind described in the introduction are already known in many embodiments. Examples of such booklets and how they are manufactured and used are to be found inter alia in the U.S. Pat. No. 3,973,787, 4,129,471, 4,289,330 and 4,367,061.

In the last-mentioned specification there is described and illustrated how a glue strip is attached to the inside of the booklet spine substantially simultaneously with crease lines being formed on either side of the strip, this giving, inter alia, the advantage that the glue strip is very carefully oriented between the crease lines, whereby folding the booklet along them can be performed without obstruction from the glue strip, and it is ensured at the same time that the edges of all the sheets of paper later inserted in the booklet are joined to the melted glue strip along the entire length of the spine, while at the same time the booklet in the area of the glue strip is given, both inside and outside, a high-quality implementation without irregularities and other deficiencies deleterious to its appearance.

A disadvantage burdening the booklet according to the U.S. Pat. No. 4,367,061 is, however, that outside sheets in a sheaf which is inserted in the booklet for joining to the inside of the booklet spine may come between the glue strip and the covers, particularly for the reason that the covers are not usually parallel, but diverge from the spine. This results in at least the outer sheets not completely coming into contact with the glue strip during the binding operation, in turn resulting in that they can come loose from the finished booklet.

To remove the disadvantage mentioned in the previous paragraph it has been proposed to apply binder and/or guide means on the insides of the covers in the vicinity of the creasing lines between the covers and the spine, as is illustrated in the three first-mentioned of the cited U.S. patent specifications, thus to ensure that all sheets in the sheaf will come into engagement against the strip on the spine. In the case where binding agent is used for this purpose, only the two outmost sheets in the sheaf will be joined to it, while the next outmost sheets and possibly further sheets in the sheaf which have come outside the glue strip will not be bound. Furthermore, the use of binding agent on the covers means an increased cost and a more complicated manufacturing method. In the case where guide means are used, the available space between the covers is decreased and an unutilised gap occurs on either side of the sheaf. In the case where the binding agent on both covers and on the strip forms a cohesive band, creasing along the creasing lines or their preparation is made more difficult as well as there being the consumption of an unnecessary large amount of binding agent.

DISCLOSURE OF INVENTION

It is one object of the present invention at least partially to remove the disadvantages with previous folders, booklets, covers and the like, as well as the disadvantages with the methods and apparatus for their manufacture.

This object is attained by the invention having been given the distinguishing features disclosed in the characterizing portions of the claims.

PREFERRED EMBODIMENTS

Figure 1:
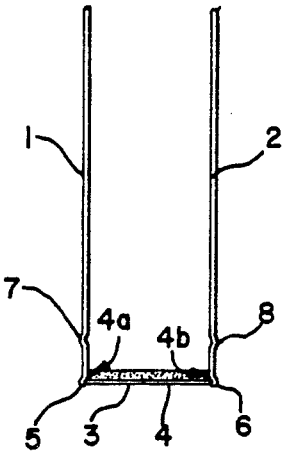
FIGS. 1 and 2 are end views of a folder, a booklet, a cover or the like (in the following designated booklet) according to two embodiments in accordance with the present invention.
Figure 2:
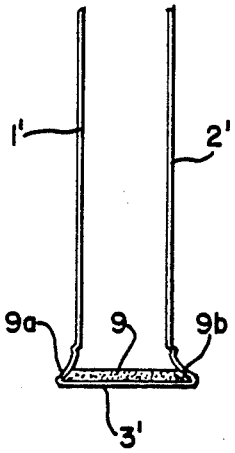

Two preferred embodiments of the booklet in accordance with the present invention, as it is produced by one of the apparatus illustrated in FIGS. 5–8, is illustrated in FIGS. 1 and 2.

Figure 4:
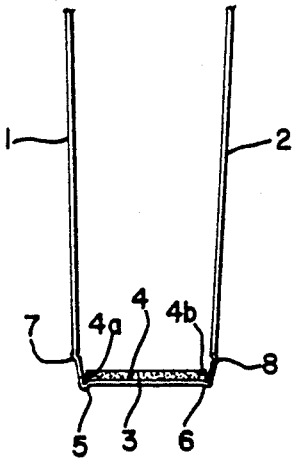
FIG. 4 is an end view of the booklet according to FIG. 3 in a folded condition.

In FIG. 1 the folder is provided with two covers 1 and 2, and a spine 3, which can be made in one piece, e.g. from carton or as separate sheets of carton and/or plastics, which are connected in some suitable way to each other. A binding agent in the form of a strip 4 is fastened to the inside of the spine 3. The binding agent consists of such as thermoplastics, hot melt glue or the like, which is in a solid state at room temperature, and on heating to a given temperature melts to become more or less liquid. The strip 4 has a rectangular or trapezoidal cross section, as shown in FIGS. 1, 2 and 4, and is immediately inside the crease lines 5 and 6 between the covers 1, 2 and spine 3. These crease lines 5 and 6 are suitably provided by creasing in connection with attaching the strip 4 to the inside of the spine and forming the crease lines 7 and 8 at a short distance from the lines 5, 6. A method and apparatus for achieving creasing and the fastening of the strip is disclosed in the U.S. patent specification 4,367,061 and also in FIG. 9. There is thus achieved that the strip 4 is oriented exactly between the lines 5, 6 so that the subsequent folding can take place un-obstructedly, without any obstruction from the strip and without the covers bulging between the lines 5, 7 and 6, 8.

Both opposing longitudinal side edges 4*a* and 4*b* of the strip 4, which are at right angles to the spine 3, are united with the insides of the covers 1 and 2 in accordance with the invention. This union is made in one or two possible ways, namely by the strip for having been fastened directly to the covers 1, 2, or with the aid of some suitable binding agent of a different kind, which does not require heating for adhesion, e.g. a cold glue, being applied to the strip before the covers are folded along the crease lines 5 and 6 in a direction towards the strip 4.

After the union between the strip 4 and the covers 1 and 2, the latter will be substantially parallel and at right angles to the strip 4, if the crease lines 5 and 6 have small transverse extensions, and this is illustrated in FIG. 1. If these crease lines have greater extension the covers 1 and 2 will converge somewhat from the strip, resulting in that the covers form guides in the area of the lines 7 and 8 for a sheaf of papers inserted in the booklet, and the risk of a sheaf with a thickness greater than the width of the strip 4 being inserted in the booklet is reduced.

A modified embodiment of the booklet is illustrated in FIG. 2, and here the booklet mainly differs from the one in FIG. 1 by the strip, now denoted 9, having a trapezoidal-shaped cross section (i.e. a cross section with two parallel sides and two converging sides) with both the longitudinal nonparallel side edges 9*a* and 9*b* united with the covers 1' and 2'. In this way these covers, substantially between the lines corresponding to the lines 5, 7 and 6, 8 in FIG. 1, will converge in a direction away from the strip 9 to form a well-defined guide for a sheaf of papers inserted in the booklet and will prevent a sheaf that is too thick from being inserted in it. In the case where the lines 5–8 in FIG. 1, and corresponding lines in FIG. 2, are creased in the way illustrated in the Figures with crease lines, which are convex seen from the inside of the booklet, the outer sheets in a sheaf inserted in the booklet are prevented from fastening on the crease lines.

In the embodiment illustrated in FIG. 1, as well as the one in FIG. 2, the strip 4 or 9 can have an upper surface which is not entirely flat. This upper surface can thus be convex, concave or may have some other suitable contour. It may also be provided with a centrally situated U- or V-shaped recess or several such recesses with small transverse extension. To achieve the mentioned union between the strip 4 or 9 and the covers 1 and 2, or 1' and 2' it is however necessary for the side edges of the strip 4 or 9 to have such large surfaces that the mentioned union can be made and maintained. The height of these surfaces should therefore not be less than about 1 mm in FIGS. 1 and 2.

Figure 3:
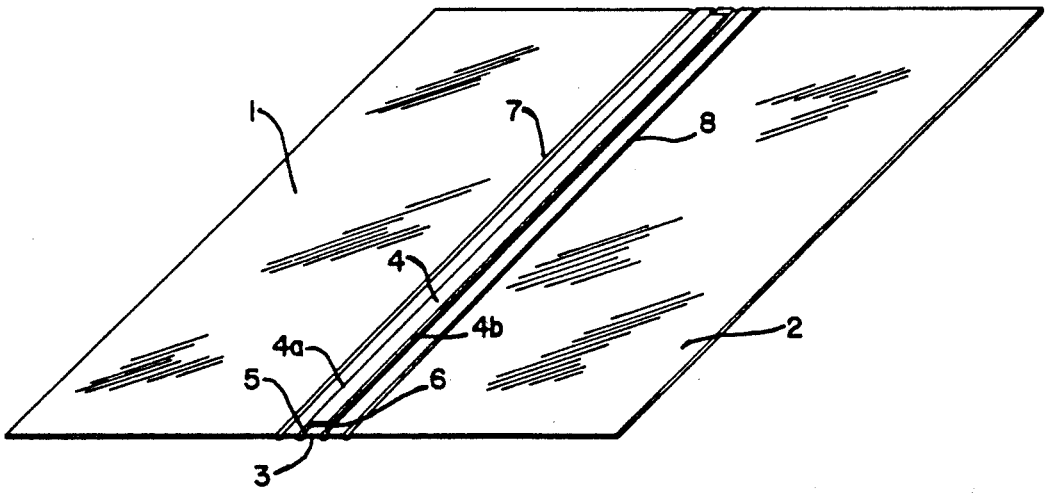
FIG. 3 is a perspective view of a previously known, unfolded booklet, which is used as starting product in manufacturing the booklet in accordance with the invention.

In FIG. 3 there is illustrated the starting material used in manufacturing the booklet according to FIG. 1 or 2, and therefore the booklet illustrated in FIG. 1 will be the only one referred to in the following. This starting material, which is substantially flat, includes the covers 1, 2 and spine 3, these being either united to each other or formed integrally, the strip 4 fastened to the inside of the spine and the crease lines 5–8. The starting material is known, and is illustrated in the above-mentioned U.S. Pat. No. 4,367,061, where there is also illustrated an apparatus for manufacturing it.

In FIG. 4 the substantially flat material illustrated in FIG. 3 is now illustrated folded along the crease lines 5 and 6, the folding having been achieved with such as the folding means illustrated in the U.S. Pat. No. 4,557,714. As will be seen from FIG. 4, the covers 1 and 2 in the vicinity of the spine 3 are spaced from the side edges 4*a* and 4*b* of the strip 4, since the booklet material has distanced itself from the strip after folding, due to its elasticity at the crease lines 5, 6.

If a booklet with the cross section illustrated in FIG. 4 where to be used for accommodating a sheaf of papers, several sheets in this sheaf could be inserted between each of the covers 1 and 2 and the respective side edge 4*a* or 4*b* of the strip, the outmost of these sheets would not then come into contact with the strip, and would thus not be attached to the booklet in the subsequent activation of the strip, thus causing the accompanying disadvantages accounted for in the introduction. In the case where the strip comprises a thermoplastic or the like, this activation takes place by heating the strip and allowing it to cool after the sheets have sunk into the softened strip. A more detailed description of the activation and an apparatus for providing it is found in such as the U.S. Pat. No. 4,367,116.

Figure 5:
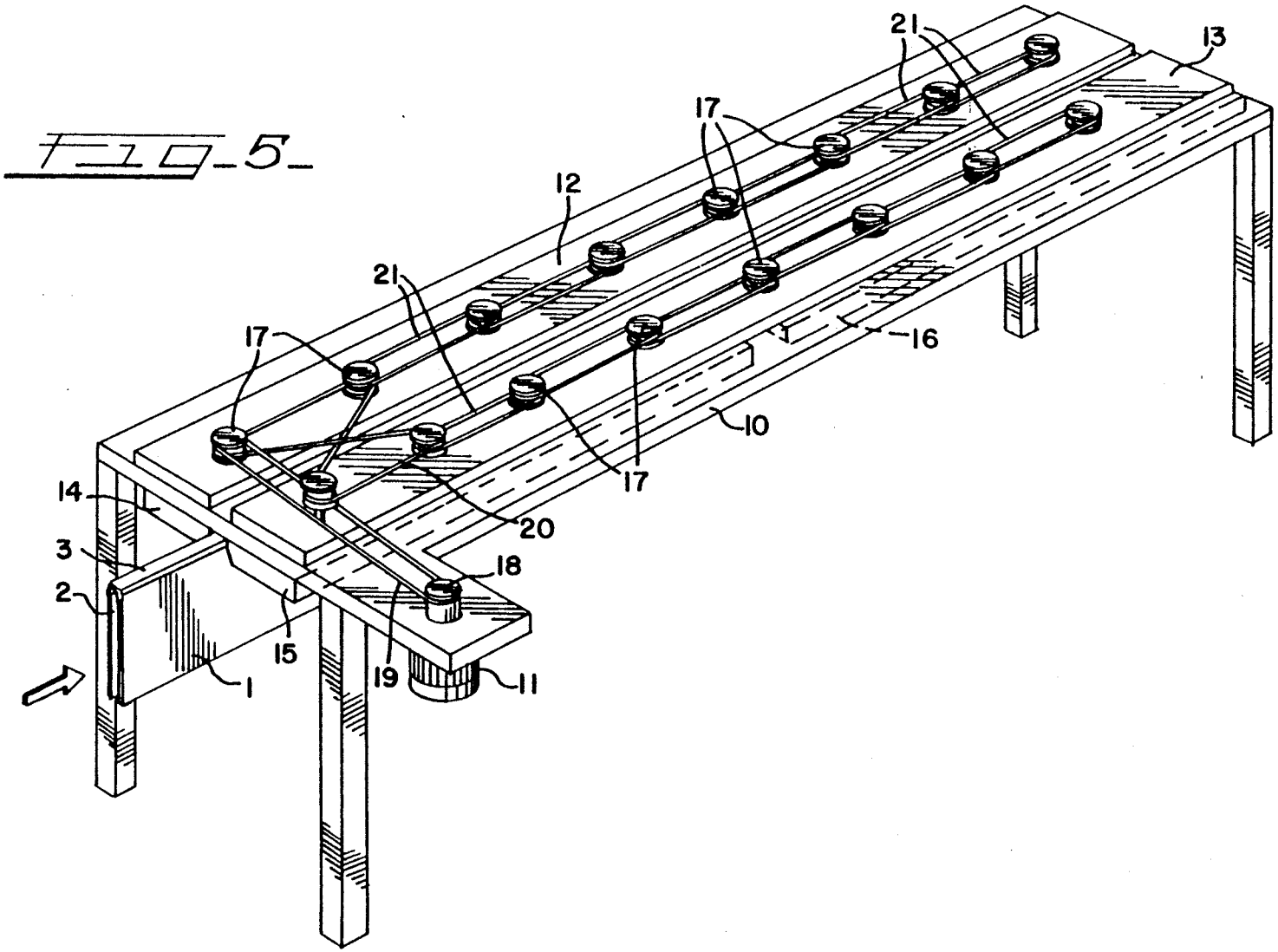
FIG. 5 is a perspective view obliquely from above of an apparatus for producing the booklet according to FIG. 1 or 2.
Figure 6:
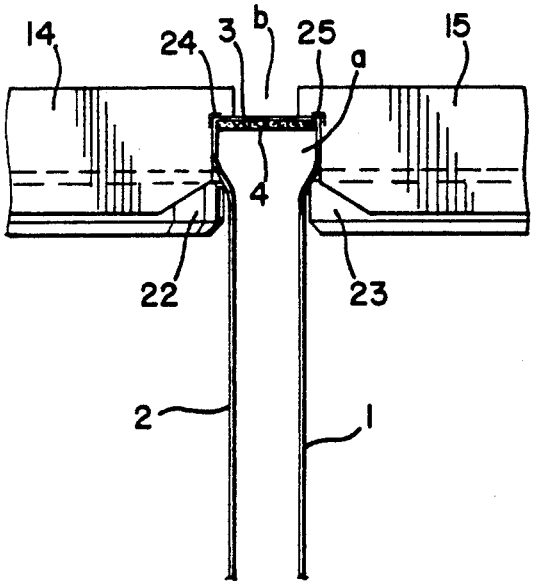
FIG. 6 is an end view of a part of the apparatus according to FIG. 5 with a booklet inserted therein.

An apparatus is illustrated in FIGS. 5 and 6 for producing the booklet illustrated in FIGS. 1 or 2, in FIG. 5 the booklet being illustrated partially inserted in the apparatus, and in FIG. 6 entirely inserted in the apparatus. Before insertion the booklet has been suitably folded to the configuration illustrated in FIG. 4.

The apparatus in FIGS. 5 and 6 includes a stand 10 placed on a floor, and on the stand there are mounted a motor 11, two upper plates 12 and 13 and four lower plates, three of these plates 14–16 being visible. The fourth plate is situated beside plate 16 and behind plate 14. A plurality of pulleys 17 are rotatably mounted on the upper plate 12 and 13 at mutual uniform spacing in the longitudinal direction of the stand, this spacing being less than the length of the booklet. The output shaft of the motor 11 is also provided with a pulley 18. With the aid of a line or cord 19 the pulley 18 drives the pulley 17 illustrated farthest to the left in FIG. 5, this pulley then driving the three nearest pulleys 17 via a cord 20. Of the three pulleys 17 just mentioned, both those furthest to the right in FIG. 5 drive the remaining pulleys 17 via identical cords 21.

Pressure rollers are mounted on the shafts of all the pulleys 17 and are accommodated in recesses in the plate 14–16 and the fourth plate. The two nearest pressure rollers 22 and 23 are illustrated in FIG. 6, and the distance between such pressure roller pairs 22, 23 is less than the exterior width of a finished booklet. In a zone (at a) immediately above the rollers 22, 23 the distance between opposing plates 14, 15 and 16 and the fourth plate is just as great as the exterior width of the booklet, whereas in a zone (at b) above zone (a) the distance is substantially smaller. The plates 14 and 15 are provided with electric heating elements 24 and 25 along their entire length where zone a merges into zone b.

When the booklet has been inserted between the plates 14, 15 and both forward pressure rollers 22, 23 in the manner illustrated in FIGS. 5 and 6, the rollers will drive the booklet through the apparatus while the booklet is retained between the plates, due to each roll pair squeezing the booklet via chamfered edges urging the booklet upwards. During the forward travel of the booklet, when the covers 1, 2 are pressed against the side edges 4*a* and 4*b* of the strip 4, these side edges are heated by the heating elements 24 and 25 via the covers and spine so that the side edges become soft. When the booklet leaves the gap between the plates 14 and 15 the side edges are so soft that they adhere to the covers 1 and 2, which are simultaneously pressed against the side edges, this adhesion being made permanent during the continued forward travel of the booklet between the plate 16 and the fourth unillustrated plate, these latter plates being insulated from the plates 14 and 15 and cool the booklet, possibly by unillustrated cooling element. When the booklet leaves the apparatus, the covers 1 and 2 are permanently united with the strip 4.

The apparatus illustrated in FIGS. 5 and 6 can be modified in different ways. For example, the pressure rollers 22, 23 can be replaced by drive rollers for belts which are in contact with the covers 1 and 2 along the whole of their length during travel through the apparatus. Neither do the pressure rollers 22, 23 need to be driven, and they can be merely rotatably mounted, thus not requiring the pulleys 17, 18, cords 19–21 and motor 11, the booklet then being taken manually through the apparatus. In such an embodiment the pressure rollers 22, 23 can also be dispensed with, and the covers of the booklet can be pressed against each other merely by the plates 14–16 and the plate behind plate 16, while the booklet is pulled manually through the apparatus. In this case the folder is also pressed upwards manually, or is pressed upwards by a bolster mounted between the sides of the booklet and against the strip 4. Instead of the heating elements 24, 25, other heating means can be used, such as hot air jets directed towards the side edges of the strip 4.

Figure 4A:
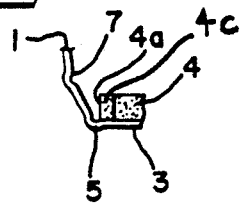
FIG. 4*a* is an end view of a modified portion of the booklet as shown in the lower left-hand corner of FIG. 1.
Figure 7:
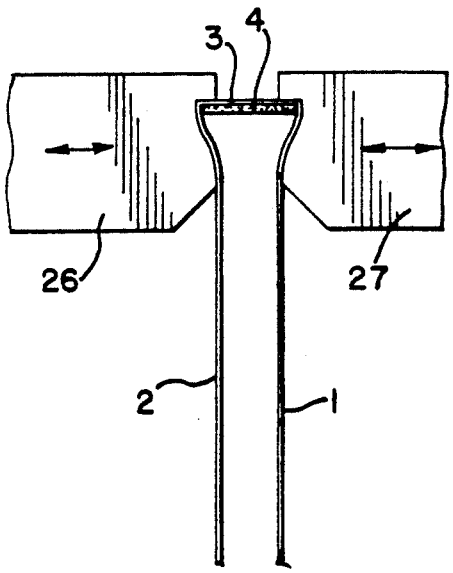
FIG. 7 is an end view corresponding to the one in FIG. 6 but schematically illustrating a second embodiment of the apparatus.

Two elongate pressure blocks 26, 27 are illustrated in FIG. 7, their length somewhat exceeding that of the booklet, and they are movable mutually reciprocally in a manner not illustrated as is conventional in the art. After inserting the booklet between the separated blocks 26, 27 they are urged towards each other to press the covers 1, 2 against the side edges 4*a*, 4*b* of the strip 4, so that the booklet is given the configuration illustrated in FIG. 1 or 2. Before the blocks are moved together, the side edges can have been provided with some suitable binder 4*c* (see FIG. 4*a*), e.g. a pressure-sensitive glue, which adheres the covers in the pressing procedure mentioned. The union between the side edges and the covers can also take place by heating and subsequent cooling of the strip side edges, e.g. by the blocks 26, 27 being provided with heating elements corresponding to those illustrated in FIG. 6 and by the provision of some suitable cooling means after the blocks. If the strip has a rectangular cross section and its edges are heated during the pressing operation, the blocks may be formed such that the strip is deformed and the booklet is given the configuration illustrated in FIG. 2.

Figure 8:
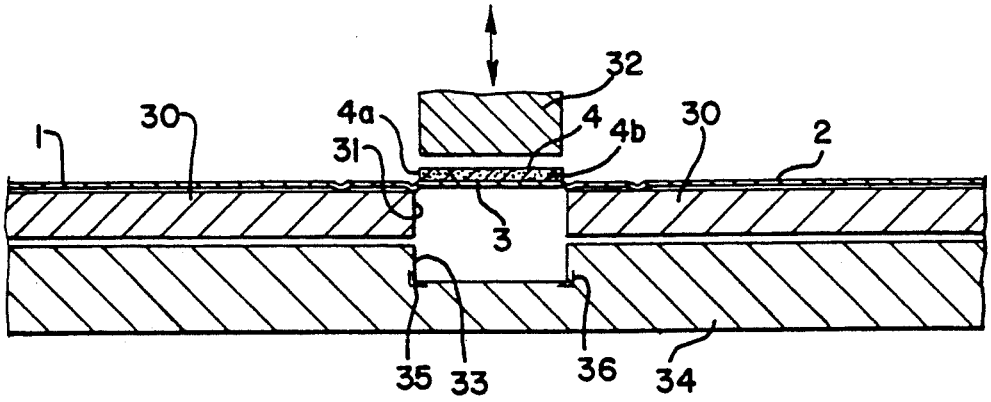
FIG. 8 is a schematic end view illustrating an alternative embodiment of the apparatus in accordance with the invention.

According to a further embodiment of the apparatus in accordance with the invention, which is illustrated in FIG. 8, the not yet folded booklet illustrated in FIG. 3 can be folded simultaneously with the covers 1 and 2 being united with the side edges 4*a*, 4*b* of the strip 4, even though the folder is not provided with creased lines. In this case the booklet is placed on a substructure 30, provided with a slot 31, somewhat wider than the strip 4, so that the strip 4 is immediately above the slot and facing upwards. A punch 32, which is just as wide as the strip 4, is given a movement downwards in FIG. 8 such as to press the strip 4 and spine 3 downwards in the slot, thus causing the covers 1 and 2 to be folded upwards along crease lines formed immediately adjacent either side. When the spine comes into engagement against the bottom of a recess 33, connecting up to the slot 31 and formed in a plate 34 insulated from the substructure 30, the covers 1 and 2 being pressed against the side edges 4*a*, 4*b* of the strip, said edges are heated by the heating elements 35 and 36 so that the edges at least partially melt. When the punch 32 and booklet are taken back upwards to a position where the side edges 4*a* and 4*b* are in the slot 31, the side edges are cooled by the cool or cooled side walls of the slot. After required cooling, the punch and booklet are taken still further upwards, whereupon the finished booklet is removed.

Instead of allowing the apparatus according to FIG. 8*b* to include heating elements 35, 36 and plate 34, glue 4*c* (see FIG. 4*a*) can be applied to the side edges 4*a* and 4*b* before, or in connection with, the not yet folded booklet being placed on the substructure 30, the covers 1 and 2 then being folded along the side edges of the strip 4 and united with these when the punch 32 presses the booklet down into the slot 31.

Figure 9:
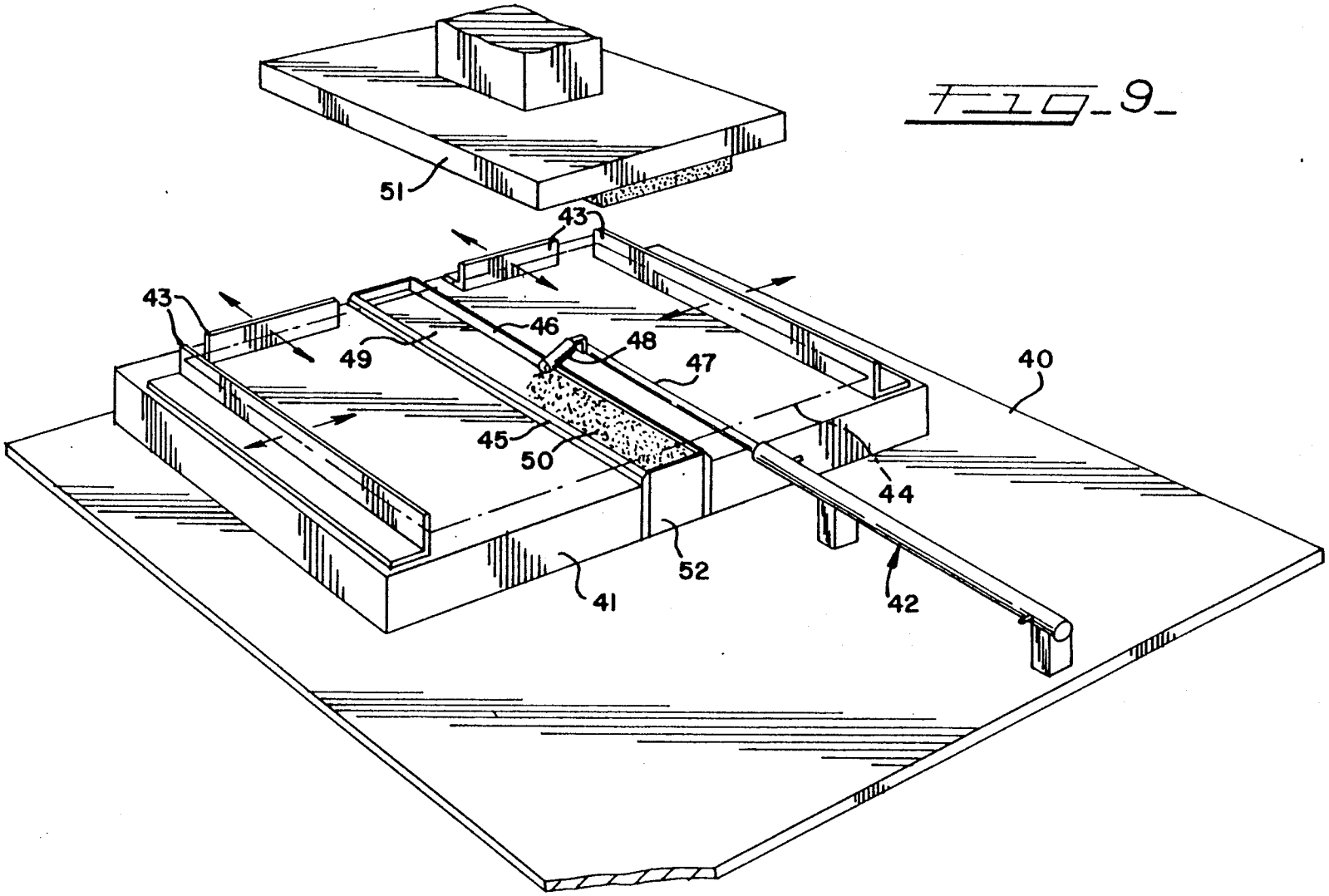
FIG. 9 is a view seen obliquely from above illustrating an apparatus for producing a blank for the booklet illustrated in FIG. 1.

A still further embodiment of the apparatus in accordance with the invention is illustrated in FIG. 9. The apparatus comprises a substructure 40, on which there is mounted a plate 41 and a spraying means 42. The plate 41 is provided with guide rails 43, which are adjustable in the horizontal plane, these guide rails being intended to align a (carton) blank 44 for registering with creasing edges 45 and 46 fastened to, and projecting above the substructure for forming crease lines 5 and 6. Crease lines 7 and 8 can be pre-formed in the blank 44. The spray means 42 comprises a piston cylinder device, the piston rod 47 of which is connected to a spray jet 48, which is supplied with liquid glue (such as hot melt lim) in a manner not illustrated. After the piston rod 47 is moved from one end to the other end of the plate 41, with the jet 48 situated directly above the trough 49 formed by the edges 45 and 46, and has deposited therein a predetermined quantity of binder 50, the blank 44 is laid between the guide rails 43. A press pillow 51 mounted above the plate 41 is then lowered to press against the blank 44, thus causing the edges 45, 46 to form crease lines 5 and 6 in it. Simultaneously with this, or immediately afterwards, the blank 44 will come into contact with the binder 50, which is in the trough 48 in the form of a more or less liquid strip, this strip then adhering to the blank. The blank 44 and strip now form an unfolded booklet similar to the one illustrated in FIG. 3, but with the difference that the strip still has not completely solidified.

Immediately after adhesion by the binder 50 (the strip) to the blank 44, the latter is folded to form the booklet illustrated in FIGS. 1, or 2, the remaining heat in the strip being utilised during folding to enable the side edges 4*a* and 4*b* of the strip to adhere firmly to the covers 1 and 2. This folding procedure may take place using any one of the methods described above with one of the apparatuses described above, either in the immediate vicinity of, or combined with the apparatus illustrated in FIG. 9. Such a combined apparatus can include: a) the bottom 52 in the trough 49 between the edges 45 and 46, this trough being displaceable vertically upwards from the position illustrated in FIG. 9, taking with it the not yet folded booklet after the press pillow 51 has been removed sufficiently far from the plate 41, and b) the substructure 30 with the slot 31 in FIG. 8, when the bottom 52 in FIG. 9 may be said to correspond to the punch 32 in FIG. 8, if this figure is viewed upside down. In an apparatus of the last mentioned kind, it is important that the binder 50 is not allowed to solidify completely before folding takes place, and displacement of the bottom 52 must take place immediately after the binder 50 is capable of carrying the blank 44 (covers 1 and 2 and spine 3) or means must be arranged for carrying the blank in some other way. The creasing edges 45, 46 may be heated to reduce the risk of cooling taking place too quickly or for reheating the cooled strip.

It also is envisioned that the apparatus of FIG. 9 can be used to apply an additional layer of binder 4*c* to the side edges 4*a* and 4*b* of the strip for securing the strip to the covers as described above.

It will be seen from the drawings and the description of the present invention that different modification and embodiments thereof are possible. Further modifications and embodiments are also possible without departing from the inventive concept.

The invention is thus limited solely by what is disclosed in the claims.

We claim:

1. Method of producing a folder or wrapper comprising two substantially parallel covers that are united with a spine at inner and outer pairs of crease lines, the spine being substantially perpendicular to the covers, and a strip of binder being rectangular or trapezoidal in cross-section and having top and bottom surfaces and two opposing longitudinal side edges, comprising the steps of attaching the strip at its bottom surface to the spine between the inner crease lines and activating substantially only the two opposing longitudinal side edges of the binder to bind the two opposing longitudinal side edges of the strip to the covers.

2. Method of producing a booklet, folder or wrapper comprising two substantially parallel covers that are united with a spine at inner and outer pairs of crease lines, comprising the steps of attaching a strip of binder being rectangular or trapezodial in cross-section and having two opposing longitudinal side edges, on the inside of the spine solely between the inner pair of crease lines, uniting the binder with the covers by activating the binder at the two opposing longitudinal side edges of said binder strip to bind the edges to the two covers and pressing the covers of the booklet against the side edges of the binder strip, and binding a sheaf of materials between the covers, whereby the booklet, folder or wrapper is produced.

3. Method as claimed in claim 2, in which the side edges are heated after the strip has been joined to the spine and has solidified.

4. Method as claimed in claim 2, in which a separate binder is applied to the side edges of the strip before the side edges are united with the covers by pressing.

5. Method as claimed in claim 2, in which the covers are pressed against the strip so that in the regions of their union with the strip they will converge in a direction away from the spine and that this convergence is maintained even after the unification operation has ceased.

6. Method as claimed in claim 2 in which the side edges of the strip are bound to the covers adjacent the inner crease lines.

7. Method as claimed in claim 2, in which during the union of the side edges of the strip with the covers, the booklet is urged in the longitudinal direction of the strip with the side edges being successively pressed along their length against the covers for being united therewith, the side edges being pressed simultaneously and transverse their length against the covers for being united therewith.

8. Method as claimed in claim 2 in which during the union of the side edges of the strip with the covers, the booklet is urged in the longitudinal direction of the strip with the side edges being moved into a slot with a width somewhat exceeding that of the strip and the side edges being pressed simultaneously and transverse their length against the covers for being united therewith.

9. An apparatus for making a cover for a booklet, said booklet comprising two substantially parallel covers, connected to a spine at formed inner and outer pairs of crease lines, a strip of binder having two opposing longitudinal side edges and being arranged solely between the inner pair of crease lines, and a sheaf of sheets of material located between the covers, said apparatus comprising means for uniting two opposing longitudinal side edges of said binder strip with the covers before a sheaf is inserted therebetween, said uniting means comprising activating means for activating substantially only the side edges of the strip for adhesion and pressing means for pressing the covers of the booklet against the side edges of the strip.

10. Apparatus as claimed in claim 9, in which the activating means comprises means that maintains a binder at a minimum temperature for adhesion and coats the side edges with an additional layer of binder.

11. Apparatus as claimed in claim 10, in which the activating means comprises spray means that sprays a hot melt to form the binder at the minimum temperature for adhesion to connect the covers.

12. An apparatus as claimed in claim 9, in which the pressing means comprises fixed elements extending along substantially the entire length of the strip, and forming between them a gap, the width of which somewhat exceeds the width of the strip, and elements for inserting the booklet in the gap with the strip disposed substantially parallel to the gap.

13. Apparatus as claimed in claim 9, in which the pressing means comprises pressure blocks substantially extending along the entire length of the strip, and means for moving at least one of the blocks to and away from the other at an angle of substantially 90° to the longitudinal direction of the strip.

14. Apparatus as claimed in claim 9, in which the pressing means include a trough having walls defining a width approximately corresponding to the width of the strip, and drive means for moving the booklet through the trough with the portions of covers adjacent side edges of the strip engaging against the walls of the trough.

15. Apparatus as claimed in claim 14, in which the drive means comprise drive rollers on either side of the trough for engaging against the covers of the booklet at a distance spaced from said portions of the covers adjacent the side edges of the strip, pairs of opposing rollers being situated at a distance from each other which is less than the width of the trough.

16. Apparatus as claimed in claim 14, in which the drive means comprise traction belts on either side of the trough for engaging against the covers of the booklet at a distance spaced from said portions of the covers adjacent the side edges of the strip, the belts being situated at a distance from each other which is less than the width of the trough.

* * * * *